US009968179B2

(12) United States Patent
Patel et al.

(10) Patent No.: US 9,968,179 B2
(45) Date of Patent: May 15, 2018

(54) WEARABLE TISSUE HOLDER

(71) Applicants: Akshay Avnissh Patel, Warren, NJ (US); Krish Avnissh Patel, Warren, NJ (US)

(72) Inventors: Akshay Avnissh Patel, Warren, NJ (US); Krish Avnissh Patel, Warren, NJ (US)

( * ) Notice: Subject to any disclaimer, the term of this patent is extended or adjusted under 35 U.S.C. 154(b) by 0 days. days.

(21) Appl. No.: 15/339,108

(22) Filed: Oct. 31, 2016

(65) Prior Publication Data

US 2017/0119136 A1 May 4, 2017

Related U.S. Application Data

(60) Provisional application No. 62/250,238, filed on Nov. 3, 2015.

(51) Int. Cl.

| | |
|---|---|
| ***A45F 5/00*** | (2006.01) |
| ***B65D 83/08*** | (2006.01) |
| ***A44C 15/00*** | (2006.01) |
| ***A47K 10/42*** | (2006.01) |
| ***A47K 10/18*** | (2006.01) |

(52) U.S. Cl.

CPC ..... *A45F 5/00* (2013.01); *A44C 15/003* (2013.01); *A47K 10/185* (2013.01); *A47K 10/421* (2013.01); *B65D 83/0805* (2013.01); *A45F 2005/008* (2013.01)

(58) Field of Classification Search

CPC ..... A45F 2005/008; A45F 5/00; A45C 1/04; A47K 10/18; A47K 10/185; A47K 10/20; A47K 10/421

See application file for complete search history.

(56) References Cited

U.S. PATENT DOCUMENTS

| | | | | |
|---|---|---|---|---|
| 4,401,233 A | | 8/1983 | Frey | |
| 4,462,116 A | * | 7/1984 | Sanzone | A41D 20/00 2/160 |
| 4,536,889 A | | 8/1985 | Taylor et al. | |
| 5,127,545 A | | 7/1992 | French | |
| D335,023 S | * | 4/1993 | Hutcheson | D2/612 |
| 5,671,481 A | * | 9/1997 | Giard | A41D 20/00 2/170 |

(Continued)

*Primary Examiner* — Corey Skurdal

(74) *Attorney, Agent, or Firm* — Sterne, Kessler, Goldstein & Fox P.L.L.C.

(57) ABSTRACT

A disposable sheet dispensing system may include a removable refillable cartridge having a disposable sheet. The disposable sheet dispensing system may include an elongate tubular body having a first end and a second end configured to receive the removable refillable cartridge. The disposable sheet dispensing system may include a fastener proximate the first end of the elongate tubular body. The disposable sheet dispensing system may include a longitudinal slit formed in the elongate tubular body between the first end and the second end configured to dispense disposable sheets from the removable refillable cartridge. The first end and the second end of the elongate tubular body may be configured to be fastened together. The fastener may be configured to selectively adjust the length of the elongate tubular body when the first and second ends are fastened together such that the holder may be adjustably worn by a user.

20 Claims, 4 Drawing Sheets

(56) References Cited

U.S. PATENT DOCUMENTS

| | | | | |
|---|---|---|---|---|
| 7,735,682 | B1 * | 6/2010 | Cassel | A47K 10/38 221/155 |
| 2002/0084279 | A1 * | 7/2002 | Lickstein | A47K 10/42 221/24 |
| 2005/0193476 | A1 | 9/2005 | Chinn | |
| 2007/0157354 | A1 | 7/2007 | Lee | |
| 2008/0190974 | A1 * | 8/2008 | Finn | A45F 5/00 224/267 |
| 2010/0001016 | A1 | 1/2010 | Savage | |
| 2013/0048695 | A1 | 2/2013 | Do | |
| 2013/0104599 | A1 | 5/2013 | Beldiman | |
| 2013/0174320 | A1 | 7/2013 | Moye | |
| 2014/0367405 | A1 | 12/2014 | Gerasimova | |

* cited by examiner

WEARABLE TISSUE HOLDER

CROSS REFERENCE TO RELATED APPLICATIONS

This application claims the benefit of U.S. provisional application Ser. No. 62/250,238, filed Nov. 3, 2015, which is included herein by reference in its entirety for all purposes.

FIELD

The invention relates generally to a system for dispensing disposable sheets.

BACKGROUND

Various types of holders or dispensers may be used to hold disposable sheets, such as tissues or sanitary wipes.

BRIEF SUMMARY OF THE INVENTION

Embodiments of the present invention relate to a disposable sheet holder. The disposable sheet holder may include an elongate tubular body having a first end and a second end and configured to receive a removable refillable cartridge having a disposable sheet. In an embodiment, the disposable sheet holder may include a fastener proximate the first end of the elongate tubular body. In an embodiment, the disposable sheet holder may include a longitudinal slit formed in the elongate tubular body between the first end and the second end configured to dispense disposable sheets from the removable refillable cartridge when inserted into the elongate tubular body. The first end and the second end of the elongate tubular body may be configured to be fastened together. In an embodiment, the fastener may be configured to selectively adjust the length of the elongate tubular body when the first and second ends are fastened together such that the holder may be adjustably worn by a user.

Embodiments of the present invention also relate to a disposable sheet dispensing system. The disposable sheet dispensing system may include a removable refillable cartridge having a disposable sheet. In an embodiment, the disposable sheet dispensing system may include an elongate tubular body having a first end and a second end configured to receive the removable refillable cartridge. The disposable sheet dispensing system may include a fastener proximate the first end of the elongate tubular body. In an embodiment, the disposable sheet dispensing system may include a longitudinal slit formed in the elongate tubular body between the first end and the second end configured to dispense disposable sheets from the removable refillable cartridge when inserted into the elongate tubular body. The first end and the second end of the elongate tubular body may be configured to be fastened together in some embodiments. In an embodiment, the fastener may be configured to selectively adjust the length of the elongate tubular body when the first and second ends are fastened together such that the holder may be adjustably worn by a user.

Additional features of embodiments of the invention will be set forth in the description that follows, and in part will be apparent from the description, or may be learned by practice of the invention. Both the foregoing general description and the following detailed description are exemplary and explanatory and are intended to provide further explanation of the invention as claimed.

BRIEF DESCRIPTION OF THE DRAWINGS/FIGURES

The accompanying figures, which are incorporated herein, form part of the specification and illustrate embodiments of the present invention. Together with the description, the figures further serve to explain the principles of and to enable a person skilled in the relevant arts to make and use the invention.

DETAILED DESCRIPTION OF THE INVENTION

Figure 1:
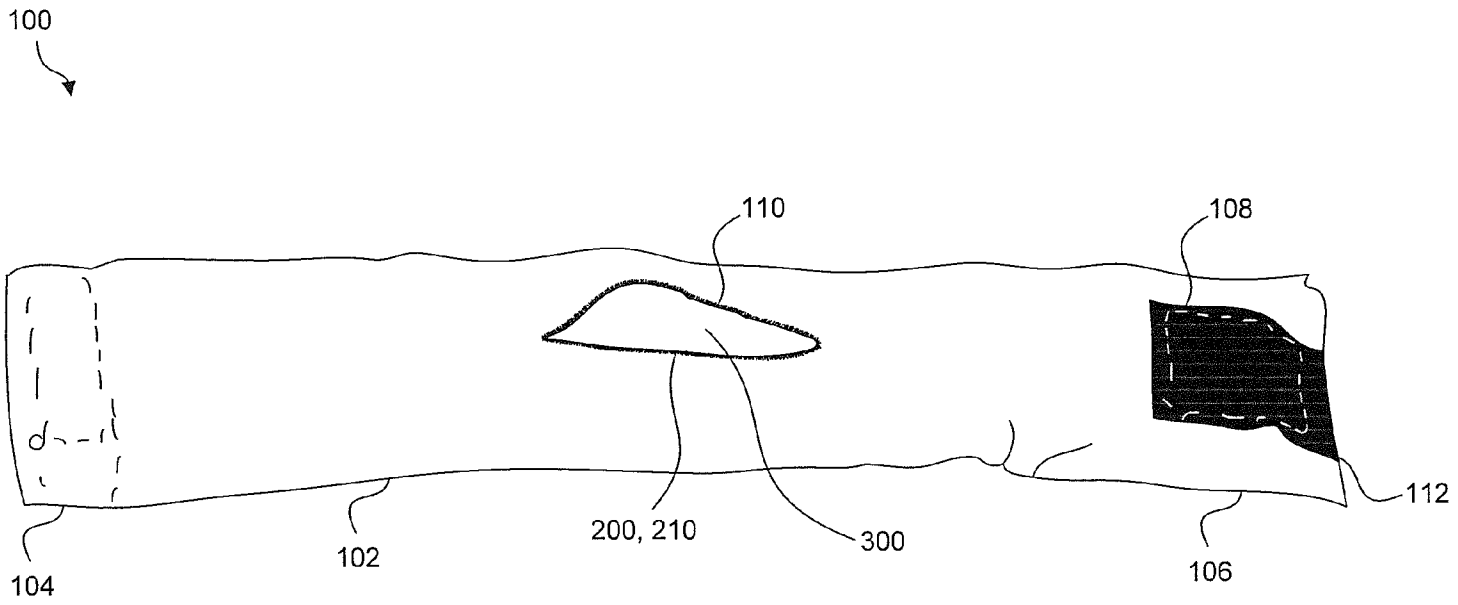
FIG. 1 is a perspective view of a disposable sheet holder system according to an embodiment of the present invention.
Figure 2:
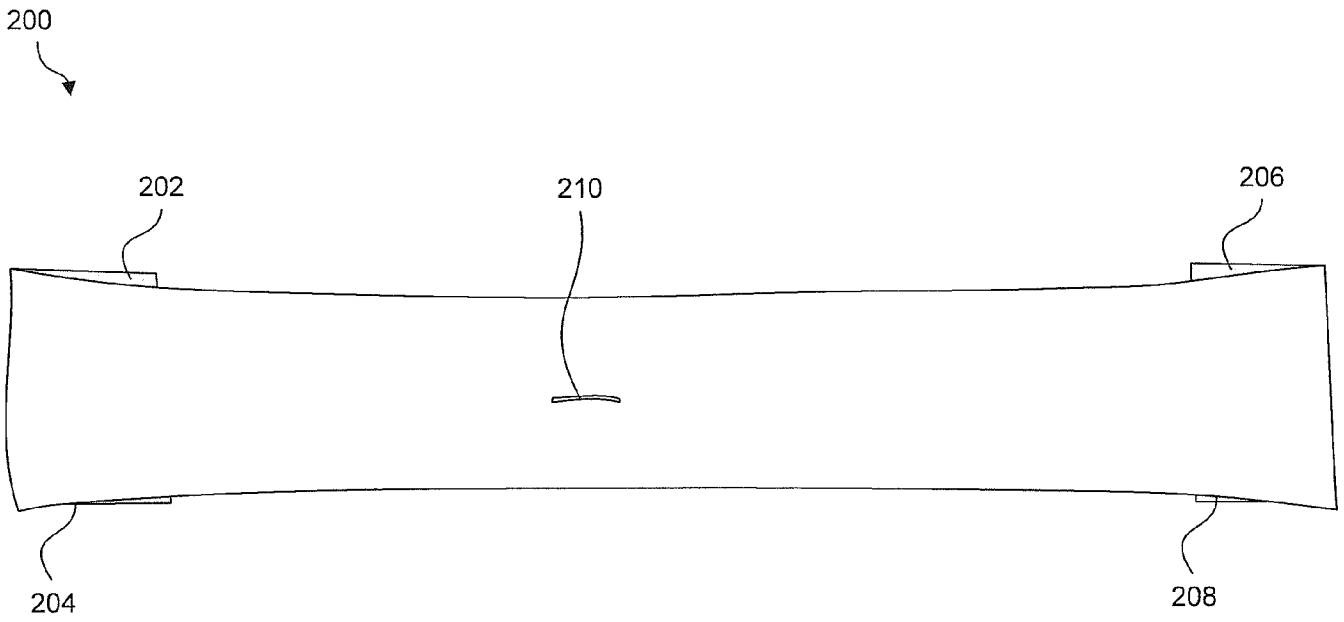
FIG. 2 is a perspective view of a cartridge according to an embodiment of the present invention.

The present invention will now be described in detail with reference to embodiments thereof as illustrated in the accompanying drawings. References to "one embodiment", "an embodiment", "an example embodiment", "some embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

There is a need for a system of an adjustable nature to accommodate different types of users (e.g. adults or children). There is also a need for a system for dispensing disposable sheets as needed in a convenient, wearable fashion. Additionally, with consumer focus on environmentally friendly products, there is a need for such a system to be reusable and refillable, resulting in an eco-friendly dispensing system solution.

FIGS. 1-5 illustrate an embodiment of system 10. As shown in the figures, system 10 may be a disposable sheet dispensing system. The system 10 may be worn, for example, around the wrist of a user. In this case, the adjustable nature of the system is advantageous to accommodate different types of users (e.g. adults or children). The system may be configured for dispensing disposable sheets as needed in a convenient, wearable fashion. Additionally, the system is reusable and refillable, resulting in an eco-friendly dispensing system solution.

System 10 may include disposable sheet holder 100, which may include an elongate tubular body 102 having a first end 104 and a second end 106. Disposable sheet holder 100 may be configured to receive a removable refillable cartridge 200 having one or more disposable sheets 300. In an embodiment, the disposable sheet holder 100 may include a fastener proximate the first end of the elongate tubular body 102. In an embodiment, the disposable sheet holder 100 may include a longitudinal slit 110 formed in the elongate tubular body 102 between the first end 104 and the second end 106 configured to dispense disposable sheets 300 from the removable refillable cartridge 200 when inserted into the elongate tubular body 102.

In an embodiment, the longitudinal slit 110 formed in the elongate tubular body 102 may be positioned proximate the midpoint of the elongate tubular body 102.

The first end 104 and the second end 106 of the elongate tubular body 102 may be configured to be fastened together. In an embodiment, the fastener 108 may be configured to selectively adjust the length of the elongate tubular body 102 when the first end 104 and second end 106 are fastened together such that the disposable sheet holder 100 may be adjustably worn by a user. In an embodiment, the elongate tubular body 102 may form a generally toroidal shape when the first 104 and second ends 106 are fastened together.

The elongate tubular body 102 may be made of flexible reusable material in an embodiment. In an embodiment, this flexible reusable material may be a fabric or textile. In an embodiment, the fabric or textile may include a pleasing aesthetic design. In some embodiments, the elongate tubular body 102 may be washable. In some embodiments, the material may be a flexible polymer. In an embodiment, the elongate tubular body 102 may be coated with particular coatings such as water-resistance coatings, stain-resistant coatings, or antibacterial or antimicrobial coatings.

In other embodiments, the elongate tubular body 102 may be provided in different overall lengths such as small, medium, large, and the like. In an embodiment, the elongate tubular body 102 may be provided in different overall lengths corresponding to disposable sheet holders 100 to be used by children or adults. In some embodiments, the disposable sheet holder 100 may be made with corresponding designs according to the target user, for example popular cartoon print designs for children's disposable sheet holder 100 compared to a neutral color palate design for an adult's disposable sheet holder 100. In an embodiment, the elongate tubular body 102 may include a logo or message to be displayed when the disposable sheet holder 100 is worn by a user.

In some embodiments, the elongate tubular body 102 or disposable sheet holder 100 may be a piece of wearable jewelry, fashion accessory, or watch. In some embodiments, the elongate tubular body 102 is reusable and refillable, resulting in an eco-friendly dispensing system solution. In some embodiments, disposable sheet 300 may be directly loaded into the elongate tubular body 102.

In some embodiments, the disposable sheet holder 100 may have a different shape or configuration. In such embodiments, the disposable sheet holder 100 may not be configured as an elongate tube in the open position. In some embodiments, the disposable sheet holder 100 may have a round configuration. In some embodiments, the disposable sheet holder 100 may be configured to be worn as a broach or pin, for example, with a suitable substitute for elongate tubular body 102. In other embodiments, the disposable sheet holder 100 may be configured to be worn as another fashion accessory, such as a scarf or hat.

In some embodiments, the disposable sheet holder 100 may have a substantially rigid configuration. In some embodiments, the elongate tubular body 102 or disposable sheet holder 100 may be made of a relatively rigid material, such as plastic or metal, while the refillable cartridge 200 may be a flexible material such as fabric, cloth, flexible plastic, or a paper product. In other embodiments, refillable cartridge 200 may be made of a relatively rigid material, such as plastic or metal, while the elongate tubular body 102 or disposable sheet holder 100 may be a flexible material such as fabric, cloth, flexible plastic, or a paper product.

The fastener 108 may be one of hook and loop, zip lock, snap, button, magnet, clasp, stitching, permanent adhesive, pressure sensitive adhesive, tie fastener, clip, or a combination thereof in an embodiment. Other suitable fastener types may also be selected for use as fastener 108. The fastener 108 may be provided proximate or on one or both of the first end 104 and second end 106 of the elongate tubular body 102. In an embodiment, the fastener 108 may be configured to selectively adjust the circumference of the elongate tubular body when the first 104 and second ends 106 are fastened together such that the disposable sheet holder 100 may be adjustably worn by a user. In other embodiments, the length or circumference of the elongate tubular body 102 may be adjusted in a manner remote from the fastener 106.

Figure 4:
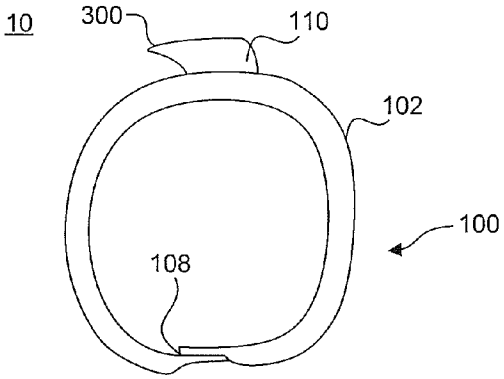
FIG. 4 is a side view of a disposable sheet holder system according to an embodiment of the present invention.
Figure 3:
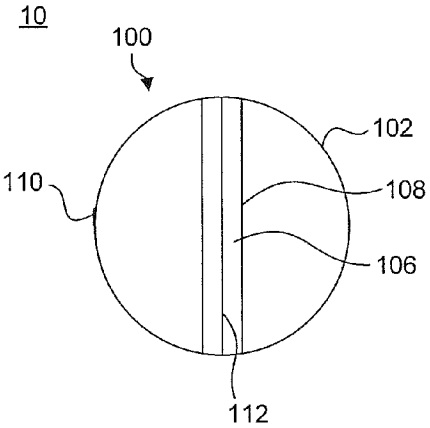
FIG. 3 is an end view of a disposable sheet holder system of a system according to an embodiment of the present invention.

As shown in FIGS. 3 and 4, in an embodiment, a generally flat portion may be formed on the first 104 or second end 106 of the elongate tubular body 102. In an embodiment, the fastener 108 may be provided on the generally flat portion. The fastener 108, when provided on the generally flat portion may aid in ease of manufacturing for example, or the adjustability of the system 10 when in use by a user.

Figure 5:
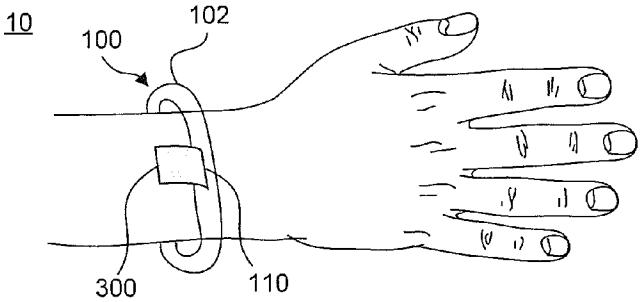
FIG. 5 is schematic view of a disposable sheet holder system in use according to an embodiment of the present invention.

As shown in FIGS. 4 and 5, the first end 104 and the second end 106 may be configured to be fastened together such that a portion of the first end overlaps a portion of the second end in an embodiment. In an embodiment, this results in an overlapping distance deemed to be an overlapping portion 114. Overlapping portion 114 may be facilitated by one or more generally flat portions formed on the first end 104 or second end 106 of the elongate tubular body 102. Advantageously, this may ensure a close fit when the disposable sheet holder 100 is worn by a user in certain embodiments. In another embodiment, the geometry of the portion where the fastener 108 is provided may be suitably altered for a desired fit or appearance.

A closure member 112 may be provided at a first 104 or second end 106 of the elongate tubular body 102 and may be configured to close an end of the elongate tubular body 102. A closure member 112 may be a first closure member 112. The first closure member 112 may be adjustable between a closed position and an open position in an embodiment. In an embodiment, a second closure member 112 may be provided at an opposite end of the elongate tubular body from the first closure member 112. In an embodiment, one of the first closure member 112 or the second closure member 112 may be permanently closed.

The closure member 112 may be one of hook and loop, zip lock, snap, button, magnet, clasp, stitching, permanent adhesive, pressure sensitive adhesive, tie fastener, clip, or combination thereof in an embodiment. Other suitable closure member types may also be selected for use as closure member 112.

In an embodiment the fastener 108 may also serve as a portion of a closure member 112. In other embodiments, the fastener 108 may serve as the entire closure member 112. In an embodiment, a first closure member 112 may be provided at a first end 104 of the elongate tubular body 102 configured to close an end of the elongate tubular body 102. In an embodiment, a second closure member 112 may be provided at an opposite end of the elongate tubular body 102 from the first closure member 112. In an embodiment, the first closure member 112 or the second closure member 112 may be permanently closed.

The system 10 may include a removable refillable cartridge 200. In an embodiment, removable refillable cartridge 200 may be inserted into the elongate tubular body 102 through any of the longitudinal slit 110, first end 104, or second end 106. The removable refillable cartridge 200 may include a plurality of disposable sheets 300. In some embodiments, the removable refillable cartridge 200 may include a first folded portion 202. In other embodiments, the removable refillable cartridge 200 may include a second folded portion 208. A longitudinal slit 210 may be provided between a first end 204 and a second end 206 of the removable refillable cartridge 200.

In an embodiment the removable refillable cartridge 200 may be made from a different material than the elongate tubular body 100. In other embodiments, the removable refillable cartridge 200 may be made from the same material as the elongate tubular body 100.

In some embodiments, the removable refillable cartridge 200 may be filled or refilled by a user. In other embodiments, the removable refillable cartridge 200 may be sold pre-filled by a manufacturer. In other embodiments, the removable refillable cartridge 200 may be disposable. In some embodiments, the disposable sheet holder 100 and the removable refillable cartridge 200 may be sold separately. In other embodiments, the disposable sheet holder 100 and the removable refillable cartridge 200 may be sold together. In some embodiments, the removable refillable cartridge 200 may be pre-filled and sold in multiple units, such as two or three removable refillable cartridges 200.

Figure 6:
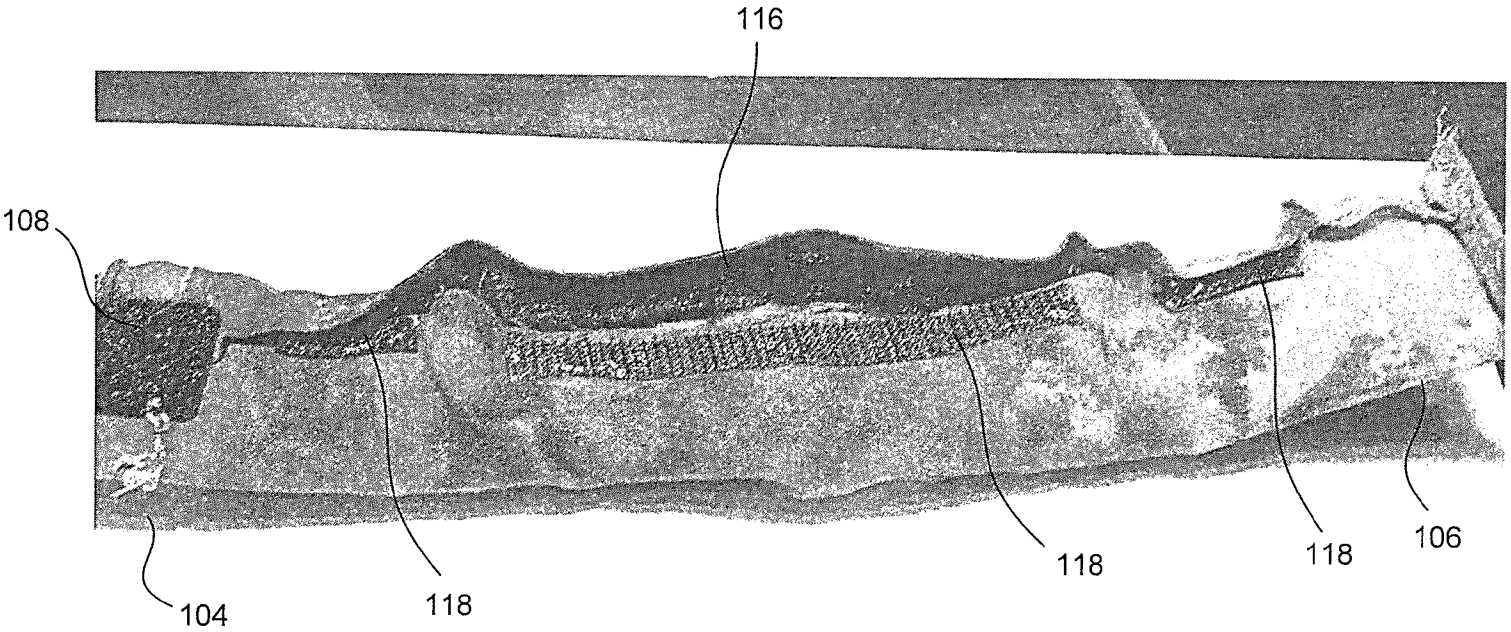
FIG. 6 is a rear perspective view of a disposable sheet holder system according to an embodiment of the present invention.

In some embodiments, as shown in FIG. 6, disposable sheet holder 100 may include a cartridge receiving slit 116 along a length of disposable sheet holder 100. Cartridge receiving slit 116 may be configured to receive removable refillable cartridge 200, or in the alternative disposable sheet 300. In some embodiments, cartridge receiving slit 116 may be configured to be closed with cartridge receiving slit closure 118. Cartridge receiving slit closure 118 may be one of hook and loop, zip lock, snap, button, magnet, clasp, stitching, permanent adhesive, pressure sensitive adhesive, tie fastener, clip, or combination thereof in an embodiment. Other suitable closure member types may also be selected for use as cartridge receiving slit closure 118.

Disposable sheet 300 may be for example, a tissue, fabric or textile, sanitary wipe, paper product, shop cloth, tape or the like. Disposable sheet 300 may be provided as a discrete unit or as one of multiple disposable sheets 300 in a pre-packaged configuration. A user may load disposable sheet 300 into the removable refillable cartridge 200 in an embodiment. In other embodiments, a user may load a pre-packaged configuration of disposable sheets into the removable refillable cartridge 200.

The elongate tubular body 102 may be manufactured by folding a plane of fabric into an elongate tubular body 102 and securing the longitudinal edges together in a seam; forming a longitudinal slit 110 formed in the elongate tubular body 102 configured to dispense tissue from a removable refillable cartridge 200 inserted into the elongate tubular body 102; sealing at least one end of the elongate tubular body 102, and providing a fastener 108 proximate an end of the elongate tubular body 102 such that the ends of the elongate tubular body 102 are configured to be fastened together.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

The claims in the instant application are different than those of the parent application or other related applications. The Applicant therefore rescinds any disclaimer of claim scope made in the parent application or any predecessor application in relation to the instant application. The Examiner is therefore advised that any such previous disclaimer and the cited references that it was made to avoid, may need to be revisited. Further, the Examiner is also reminded that any disclaimer made in the instant application should not be read into or against the parent application.

What is claimed is:

1. A disposable sheet holder, comprising:

a removable refillable cartridge configured to dispense disposable sheets;

an elongate tubular body having a first end and a second end and configured to receive the removable refillable cartridge;

a fastener proximate the first end of the elongate tubular body;

a longitudinal slit formed in the elongate tubular body between the first end and the second end configured to dispense disposable sheets from the removable refillable cartridge when inserted into the elongate tubular body; and a first closure member provided at a first or second end of the elongate tubular body configured to close an end of the elongate tubular body, wherein the fastener serves as the first closure member, wherein the first end and the second end of the elongate tubular body are configured to be fastened together; and wherein the fastener is configured to selectively adjust the length of the elongate tubular body when the first and second ends are fastened together such that the disposable sheet holder may be adjustably worn by a user.

2. The disposable sheet holder of claim 1, wherein the first end and the second end are configured to be fastened together such that a portion of the first end overlaps a portion of the second end.

3. The disposable sheet holder of claim 1, wherein the fastener is configured to selectively adjust the circumference of the elongate tubular body when the first and second ends are fastened together such that the holder may be adjustably worn by a user.

4. The disposable sheet holder of claim 1, further comprising:

a generally flat portion formed on the first or second end of the elongate tubular body.

5. The disposable sheet holder of claim 4, wherein the fastener is provided on the generally flat portion.

6. The disposable sheet holder of claim 1, wherein the fastener is one of hook and loop, zip lock, snap, button, magnet, clasp, stitching, permanent adhesive, pressure sensitive adhesive, tie fastener, clip.

7. The disposable sheet holder of claim 1, wherein the first closure member is adjustable between a closed position and an open position.

8. The disposable sheet holder of claim 1, further comprising a second closure member provided at an opposite end of the elongate tubular body from the first closure member.

9. The disposable sheet holder of claim 8, wherein one of the first closure member or the second closure member is permanently closed.

10. The disposable sheet holder of claim 1, wherein the first closure member is one of hook and loop, zip lock, snap, button, magnet, clasp, stitching, permanent adhesive, pressure sensitive adhesive, tie fastener, clip.

11. The disposable sheet holder of claim 1, wherein the longitudinal slit formed in the elongate tubular body is positioned proximate the midpoint of the elongate tubular body.

12. The disposable sheet holder of claim 1, wherein the elongate tubular body is made of flexible reusable material.

13. The disposable sheet holder of claim 1, wherein the elongate tubular body forms a generally toroidal shape when the first and second ends are fastened together.

14. The disposable sheet holder of claim 1, wherein the elongate tubular body is a piece of wearable jewelry, fashion accessory, or watch.

15. A disposable sheet dispensing system, comprising:

a removable refillable cartridge having a disposable sheet, an elongate tubular body having a first end and a second end configured to receive the removable refillable cartridge, a fastener proximate the first end of the elongate tubular body, a longitudinal slit formed in the elongate tubular body between the first end and the second end configured to dispense disposable sheets from the removable refillable cartridge when inserted into the elongate tubular body;

wherein the first end and the second end of the elongate tubular body are configured to be fastened together; and wherein the fastener is configured to selectively adjust the length of the elongate tubular body when the first and second ends are fastened together such that the disposable sheet holder may be adjustably worn by a user.

16. The disposable sheet dispensing system of claim 15, wherein the elongate tubular body is made of flexible reusable material.

17. The disposable sheet dispensing system of claim 16, wherein the removable refillable cartridge is made from a different material than the elongate tubular body.

18. The disposable sheet dispensing system of claim 16 further comprising:

a second closure member provided at an opposite end of the elongate tubular body from the first closure member; wherein the first closure member is permanently closed.

19. The disposable sheet dispensing system of claim 15, further comprising:

a first closure member provided at a first end of the elongate tubular body configured to close an end of the elongate tubular body.

20. The disposable sheet dispensing system of claim 19, wherein the fastener serves as the second closure member.

* * * * *